United States Patent [19]

Berges et al.

[11] Patent Number: 4,483,667

[45] Date of Patent: Nov. 20, 1984

[54] VACUUM PUMP AND METHOD OF OPERATING THE SAME

[75] Inventors: Hanns-Peter Berges; Peter Frieden; Hans-Peter Kabelitz, all of Cologne, Fed. Rep. of Germany

[73] Assignee: Leybold-Heraeus GmbH, Cologne, Fed. Rep. of Germany

[21] Appl. No.: 450,423

[22] Filed: Dec. 16, 1982

[30] Foreign Application Priority Data

Dec. 17, 1981 [DE] Fed. Rep. of Germany ..... 3150033

[51] Int. Cl.[3] ..... F01C 21/04; F04C 27/02; F04C 25/02

[52] U.S. Cl. ..... 418/84; 418/87; 418/88; 418/97; 417/281; 417/295; 417/298; 417/299

[58] Field of Search ..... 418/DIG. 1, 84, 87, 418/88, 89, 97, 99, 98; 417/279, 281, 295, 298, 299, 307; 184/15.1; 137/498.3

[56] References Cited

U.S. PATENT DOCUMENTS

| | | | |
|---|---|---|---|
| 930,843 | 8/1909 | Cook | 417/295 |
| 3,105,630 | 10/1963 | Löwler et al. . | |
| 3,168,236 | 2/1965 | Lamberton et al. . | |
| 3,191,854 | 6/1965 | Löwler et al. . | |
| 3,707,339 | 12/1972 | Budgen | 418/87 |
| 4,366,834 | 1/1983 | Hanson | 137/489.3 |

FOREIGN PATENT DOCUMENTS

| | | |
|---|---|---|
| 1179666 | 10/1964 | Fed. Rep. of Germany . |
| 1190134 | 4/1965 | Fed. Rep. of Germany . |
| 1728459 | 1/1973 | Fed. Rep. of Germany . |
| 2241920 | 3/1973 | Fed. Rep. of Germany . |
| 1282666 | 12/1961 | France . |
| 970900 | 9/1964 | United Kingdom . |
| 1195361 | 6/1970 | United Kingdom . |

OTHER PUBLICATIONS

H. Wycliffe and B. D. Power, Pumped Oil Feed Systems for Rotary Vacuum Pumps, Apr. 1981, pp. 1160–1162.

*Primary Examiner*—William R. Cline
*Assistant Examiner*—John J. McGlew, Jr.
*Attorney, Agent, or Firm*—Spencer & Frank

[57] ABSTRACT

A vacuum pump comprises a suction nipple valve including a cylinder, a piston slidably received therein and a movable valve closing member operatively connected to the piston. The vacuum pump further has a pressure medium conduit having a first end communicating with the cylinder; an inlet opening at a second end of the conduit for pressure medium to flow through the inlet opening to the piston; a control arrangement for closing and opening the inlet opening dependent upon run or standstill of the vacuum pump. In the closed state of the inlet opening an oil quantity is maintained above the inlet opening.

14 Claims, 4 Drawing Figures

FIG. 2
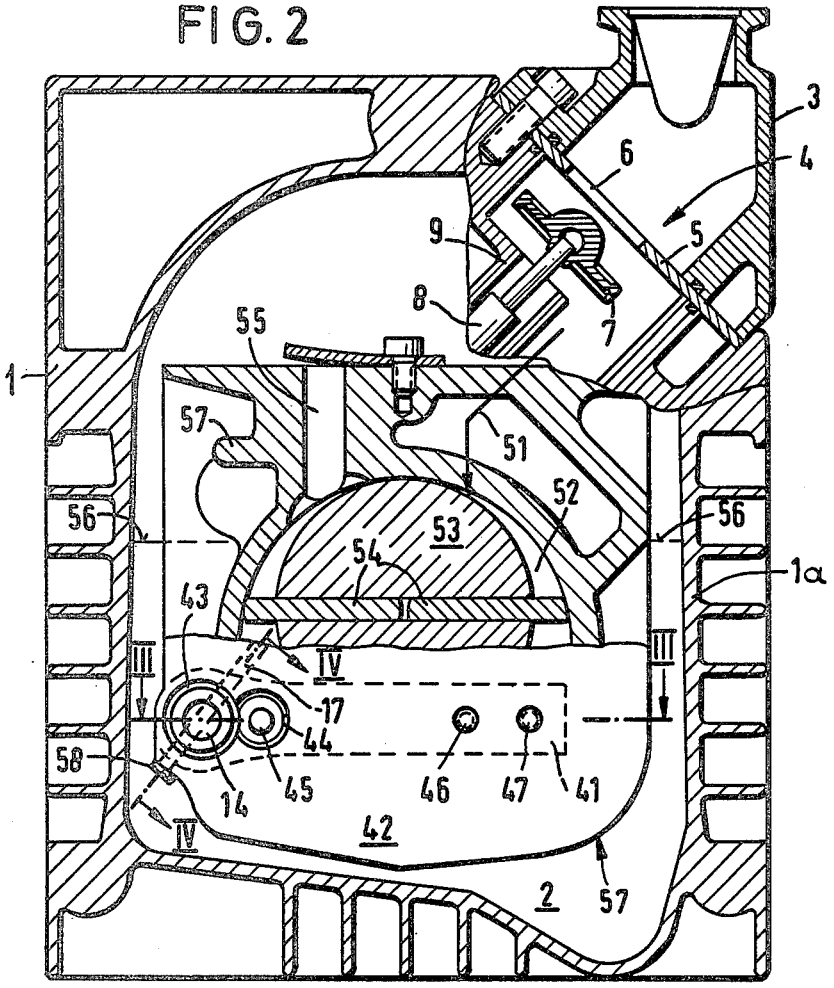
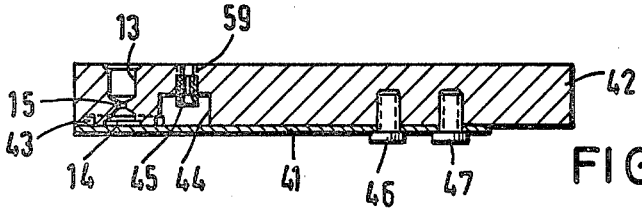
FIG. 3
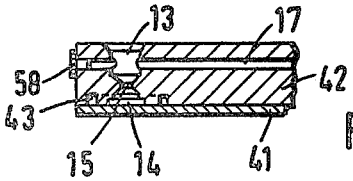
FIG. 4

VACUUM PUMP AND METHOD OF OPERATING THE SAME

BACKGROUND OF THE INVENTION

This invention relates to a vacuum pump having a suction nipple valve which includes a closure element coupled with the piston of a cylinder-and-piston assembly. One end of a pressure medium conduit opens into the cylinder of the cylinder-and-piston assembly, while the other end of the conduit has an inlet opening which is opened or closed as a function of the operational state of the pump. The invention further relates to a method of operating a vacuum pump which has a suction nipple valve actuated as a function of the operational state of the pump.

Rotary vacuum pumps are driven by means of sealing liquids, preferably oil, in order to achieve a high final vacuum. At the same time, the oil serves for lubricating the bearings and for cooling the pump. After stopping pumps of the above-outlined type—either by usual de-energization or because of power failure or other operational malfunction—there are risks that the oil rises in the oil receptacle particularly if the latter is under vacuum. Such occurrence causes undesired soiling. In order to avoid these disadvantages, a number of solutions are known which are described in an article by Dieter Knobloch and Heinrich Oehmig entitled "Saugstutzensperre verhindert Ölrücksteigen an rotierenden Vakuumpumpen" (Suction Nipple Shutoff Prevents Oil Backup in Rotary Vacuum Pumps), published in the periodical Maschinenmarkt (Würzburg, Federal Republic of Germany), Issue 79 (1973) 54, pages 1191–1193. As illustrated in FIG. 4 of the article, it is known to provide a vacuum pump with a suction nipple valve of the type described above. The pressure medium is air. The inlet opening of the pressure medium conduit is either closed or open, dependent upon the operational condition of the pump. For this purpose, on the pump shaft a centrifugal switch is mounted, by means of which the inlet opening of the conduit is closed upon the start-up of the pump. In this manner, the opening movement of the closure element of the suction nipple valve is effected. If the vacuum pump, for whatever reason, comes to a standstill, the centrifugal switch opens the inlet opening so that air under atomospheric pressure penetrates into the cylinder containing the piston of the suction nipple valve. This occurrence thus effects a closing motion of the suction nipple valve. Further, a nozzle is provided through which an aeration of the pump chamber occurs subsequent to the closing motion of the closure element of the suction nipple valve.

It is a disadvantage of the above-described solution that the undesired air intake which effects an increase of the pressure in the oil receptacle communicating with the intake nipple is still present because it cannot be entirely avoided that one part of the air which causes the motion of the valve piston penetrates between the piston and the cylinder into the suction chamber during a period when the suction nipple valve has not yet assumed its closed position. Additionally, air penetrates into the suction chamber—and increases thus the air intake—through the nozzle which serves for the aeration of the pump chamber. The air intake could be prevented in the known solutions only by ensuring that there prevails only a very narrow clearance between the piston and the cylinder and by omitting the nozzle which serves for a subsequent aeration of the pump. Such a solution, however, would have not only the disadvantage that an automatic aeration of the pump chamber upon reaching standstill no longer occurs but also, that the cylinder-and-piston assembly is very sensitive against soiling and must be made with extremely small tolerances. If, for example, a soiling by oil occurs which is often the case in rotary vane type pumps, then the suction nipple valve no longer operates reliably. The opening period will be significantly lengthened; in case of small pressure differences the valve will not open at all. It is a further disadvantage of decreasing the play that the manufacturing costs increase significantly.

SUMMARY OF THE INVENTION

It is an object of the invention to provide an improved vacuum pump of the above-discussed type in which, despite relatively large tolerances in the cylinder-and-piston assembly for the suction nipple valve, the undesirable air admission practically no longer occurs.

This object and others to become apparent as the specification progresses, are accomplished by the invention, according to which, briefly stated, above the inlet opening of the pressure medium conduit a quantity of oil is maintained.

When a pump arranged according to the invention is stopped then—at least initially—not air but oil is admitted underneath the piston (which operates the suction nipple valve) so that an air intake can no longer occur.

Advantageously, the oil quantity which raises above the inlet opening of the pressure medium conduit is so selected that it is just sufficient to serve solely for sealing the piston against the cylinder wall and for sealing the nozzle (if such is present) that serves for the subsequent aeration of the pump chamber. After the oil has fulfilled its sealing function, air enters underneath the piston. Such a hydro-pneumatic operation of the suction nipple valve has, as compared to an exclusively hydraulic operation, the advantage of significantly shorter closing times.

According to a further feature of the invention, the clearance between the piston and the cylinder is selected to be of such a magnitude that subsequent to the closing of the suction nipple valve, the aeration of the pump is effected through the available clearance. Thus, in such an arrangement, a separate nozzle for the aeration of the pump chamber is no longer necessary. Further, the manufacture of the cylinder and piston devices with a relatively large clearance does not involve high manufacturing costs.

It is a further advantage of the invention that the control of the suction nipple valve may be effected as a function of the oil pressure in an oil circuit serving, for example, for the lubrication of the bearings of the vacuum pump. In this manner, a hydro-pneumatic actuation of the suction nipple valve may be effected particularly simply and reliably.

BRIEF DESCRIPTION OF THE DRAWING

FIG. 2 shows a preferred embodiment of a vacuum pump according to the invention, illustrated partially in section and partially as viewed in the direction of the front side of the pump body.

FIG. 3 is a sectional view taken along line III—III of FIG. 2.

FIG. 4 is a sectional view taken along line IV—IV of FIG. 2.

DESCRIPTION OF THE PREFERRED EMBODIMENT

Figure 1:
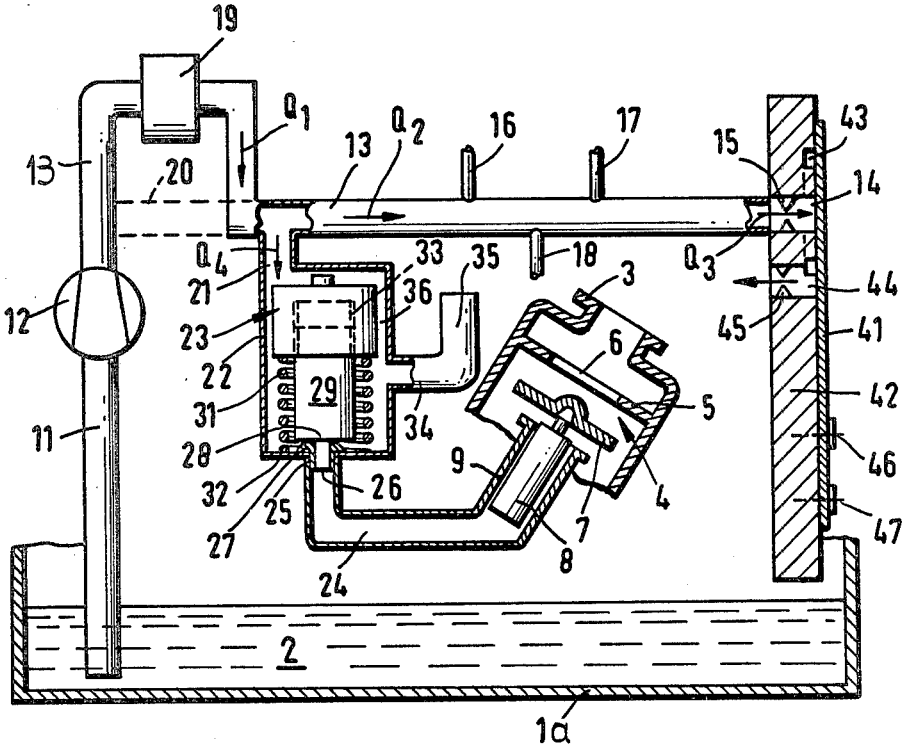
FIG. 1 is a schematic elevational view of an oil circuit associated with a vacuum pump, according to a preferred embodiment of the invention.

Turning now to FIG. 1, there are shown, in essence, those components of a vacuum pump which are deemed to aid in understanding the invention. Thus, the pump comprises an outer housing 1 including an oil sump 1*a* which is partially filled with oil 2. There is further shown a suction nipple 3 and a suction nipple valve 4, the latter being formed by a plate-like valve seat 5 provided with an opening 6 and a movable valve disc 7. The valve disc 7 is connected with a piston 8 which is displaceable in a cylinder 9.

The oil circuit of the vacuum pump comprises a suction conduit 11 through which, by means of an oil pump 12, oil is drawn from the sump 1*a* and driven into a pressure conduit 13. In the zone of the outlet opening 14 of the pressure conduit 13 there is arranged a throttle (pressure reducer) 15 which maintains the desired oil pressure (between 1.5 and 2 bar, preferably 1.7 bar) and by means of which the pressure of the oil is reduced to the pressure prevailing in the oil sump 1*a*. The bearings of the vacuum pump are supplied with pressurized oil by means of branch conduits 16, 17 and 18 of the oil circuit. Three oil supply conduits (16, 17 and 18) are required in case of a two-stage pump in which two end bearings and one intermediate bearing of the two rotors have to be supplied with oil. In case of a one-stage pump, two branch conduits are sufficient. After the pressurized oil supplied by the branch conduits 16, 17 and 18 has passed through the bearings, it returns to the oil sump 1*a*.

In the pressure conduit 13, immediately downstream of the oil pump 12, there is arranged an oil filter 19 to ensure that exclusively purified oil flows in the pressure conduit 13 and the branch conduits downstream of the oil filter 19.

A further branch conduit 21 extends from the pressure conduit 13 and opens into a control cylinder 22 which accommodates a control piston 23. An oil conduit 24 opens, at 25, into the control cylinder 22 at that side of the control piston 23 which is oriented away from the inlet of the conduit 21. The other end of the conduit 24 opens into the cylinder 9 adjacent that face of the piston 8 which is oriented away from the valve disc 7. The inlet opening 25 of the conduit 24 receives a plug 26 surrounded by a sealing grommet 27 to form a valve seat. The closing member of this valve is an end face 28 of a cylindrical extension 29 of the control piston 23. The extension 29 has a smaller diameter than that of the control piston 23. The control piston 23 is biased open by a spring 31 which is arranged between a shoulder of the control piston 23 and a cylinder end wall 32 which contains the inlet opening 25 of the conduit 24. The cylindrical extension 29 is threadedly engaged in the control piston 23 by means of a thread 33 so that the force of the spring 31 which acts when the control valve 27, 28 is in a closed position, may be varied.

A small-volume, open-top oil storage vessel 35 communicates with the control cylinder 22 by means of a conduit 34. The inlet opening of the conduit 34 in the cylinder 22 is adjacent that end face of the control piston 23 which is oriented away from the inlet of the conduit 21.

During operation of a vacuum pump constructed as described above, the oil pump 12 delivers oil from the oil sump 1*a* into the pressure conduit 13. The oil pump 12 may be a rotary vane pump or a gear pump and may be coupled to the vacuum pump shaft for being driven thereby, as described, for example, in British Pat. No. 875,444. The delivery characteristics of the oil pump 12 and the size of the throttle 15 are so designed that after the start of the vacuum pump the desired oil pressure is built up and maintained in the pressure conduit 13. The pressure in the conduit 13 exerts a force on the piston 23 and overcomes the force of the spring 31, so that the inlet opening 25 of the oil conduit 24 is closed. The suction nipple valve 4 is, under these conditions, in its open position so that the vessel coupled to the nipple 3 is evacuated.

During the above-outlined operational conditions predetermined oil quantities, designated at $Q_1$, $Q_2$ and $Q_3$ flow through the pressure conduit 13. The piston 23 defines, with the wall of the cylinder 22, a relatively wide clearance 36 so that the chamber of the cylinder 22 underneath the piston 23 and the oil storage vessel 35 are filled with oil. By virtue of the clearance 36 a steady oil flow of a quantity $Q_4$ is maintained through the conduit 21. Excess oil is returned by overflow from the oil storage vessel 35 to the sump 1*a*. The oil pump 12 is so dimensioned that the entire oil circuit is operated with excess oil, that is, at all times more oil flows in the circuit than required by the vacuum pump.

When the vacuum pump is shut off, the oil quantities delivered by the oil pump simultaneously decrease so that the oil pressure in the pressure conduit 13 is reduced. When the pressure in the conduit 13 falls below a predetermined value, the force of the spring 31 lifts the piston 23 off the opening 25, so that by virtue of the atmospheric pressure prevailing at the upper surface of the oil in the oil reservoir 35, oil is forced into the conduit 24 and is introduced underneath the piston 8 into the cylinder 9. The oil quantity underneath the piston 23 and in the oil reservoir 35 is so small that the oil introduced into the cylinder 9 serves essentially only for sealing the piston 8 against the cylinder wall in which it slides. The pressure medium proper for actuating the piston 8 is air which is introduced into the conduit 24 behind the oil through the oil reservoir 35. For this reason, the upper and lower limits of the entire oil quantity present in the cylinder 22 and the oil storage vessel 35 are so selected that, on the one hand, there is ensured an oil seal of the clearance defined between the piston 8 and the cylinder 9 during the valve closing step and, on the other hand, the pump is aerated shortly after it is de-energized. These occurrences ensure a closing of the suction nipple valve 4 without an undesirable intake of air. After the suction nipple valve 4 is closed and the air entering behind the oil has displaced the oil situated between the piston 8 and the cylinder wall 9, an airing of the pump chamber occurs. The operation of the suction nipple valve control is independent from the presence of the oil filter 19, that is, even in an oil circuit without an oil filter (as symbolized by the broken-line bypass 20), the suction nipple valve 4 and its control operate in a satisfactory manner.

A particular advantage of the construction of the suction nipple valve 4 and its control operating as a function of the oil pressure resides in that both cylinder and piston arrangements 8, 9 and 22, 23 are, because of the desired clearance between respective piston and cylinder not subject to strict manufacturing tolerances and therefore are inexpensive to make. By appropriate choice of the oil quantities $Q_1$ and $Q_4$, the diameter of the passage of the throttle 15 and by a corresponding adaptation of the force of the spring 31, the control arrangement may be adjusted such that even at relatively small pressure drops in the oil circuit (for example, a decrease of the desired pressure from approximately 1.7 bar to 1.4 bar) the inlet opening 25 of the conduit 24 is opened. The delay of response of the suction nipple valve 4 is, due to the hydro-pneumatic actuation, so short that it is ensured that even before standstill (that is, during inertia runout) of the vacuum pump the suction nipple valve 4 is closed. In general, the actuation of the suction nipple valve by means of the oil pressure in an oil circuit which is supplied by a vacuum pump shaft-driven oil pump has the advantage of a rapid and reliable operation, since the operational condition of the vacuum pump is unequivocally indicated by the oil pressure in the oil circuit.

With the outlet opening 14 of the pressure conduit 13 there is associated a spring biased closure 41 which, together with a particularly structured wall 42 in the zone of the outlet opening 14 performs several functions. The outlet opening 14 is surrounded by a groove 43 which is provided in the wall 42 and which is concentric with the outlet opening 14. The groove 43 extends to a bore 44 through which oil passes for supplying the pump chamber. The bore 44 is provided with a throttle 45 whose size is adapted to the suction power of the vacuum pump. The resilient closure 41 which is preferably an elastic steel strip, covers both the outlet opening 14 of the oil pressure conduit 13 and the bore 44. The spring force of the resilient closure 41 and the distance of its mounting points 46, 47 on the wall 42 from the oil ports 14 and 44 are so selected that they effect only a negligible pressure drop for the oil exiting the outlet opening 14. Thus, for all practical purposes, the oil is discharged through the outlet opening 14 with the pressure prevailing in the sump 1*a*. Further, at this location of the oil circuit too, the circulation is effected by means of excess oil, that is, even at the final pressure run of the vacuum pump, more oil is discharged through the outlet opening 14 than drawn by the pump through the throttle 45 arranged in the bore 44.

During operation of the vacuum pump, oil under pressure is, by virtue of the throttle 15, depressurized to the pressure prevailing in the oil sump 1*a*. The depressurized oil first flows into the groove 43 surrounding the outlet opening 14. From the groove 43 which communicates with the bore 44, one part of the oil flows, by virtue of the suction effect of the pump chamber, through the throttle 45 of the bore 44. Excess oil is reintroduced into the oil sump 1*a*. The resilient closure 41 ensures that only oil which has left the outlet opening 14 flows through the bore 44 and the throttle 45. Therefore, exclusively oil which has flown through the oil filter 19 is introduced into the vacuum pump chamber and consequently, the pump chamber cannot be endangered by soiled oil. Nevertheless, the vacuum pump operates as a self-drawing pump, that is, it determines itself the oil quantities it requires. In high pressure ranges, for example, small oil quantities flow through the throttle 45, so that undesirably high oil vapor components are no longer present in the gas removed by the vacuum pump. It is independently ensured that the vacuum pump bearings are supplied with pressurized lubricating oil.

Further, the resilient closure 41 and the groove 43 effect an oil shutoff during standstill of the vacuum pump. In such an operational condition the vacuum prevailing in the pump chamber causes, through the bore 44, the resilient closure 41 to be tightly pressed against the wall 42. In this manner, the closure 41 completely seals the bore 44 so that no oil supply to the vacuum pump can take place. This solution yields a further advantage: in general, it has been a problem that during an accidental reverse run of the pump (because of an erroneous switching) an undesired oil increase in the suction nipple 3 could occur. With the above-described arrangement, however, such oil increase is reliably prevented.

Turning now to FIG. 2, there is illustrated in section a rotary vane-type vacuum pump. During the operation of the pump the delivered gases, after they flow through the suction nipple 3, the open suction nipple valve 4 and a suction channel (designated by an arrow 51) are admitted into the pump chamber 52 which accommodates a rotor 53 with the vanes 54. The compressed gases are introduced through the outlet channel 55 into the oil sump 1*a* which is filled with oil up to the line 56 so that the resilient closure 41 is situated underneath the oil surface. The exhaust nipple proper is not shown.

The end wall 42 of the pump block 57 arranged in the oil sump 1*a* of the pump housing 1 is shown in elevation at its lower portion. Sections III—III and IV—IV taken through the frontal wall are illustrated in FIGS. 3 and 4. The pressure conduit 13 with the throttle 15 terminates in the front wall 42. Prior to the depressurization of the oil to the pressure prevailing in the oil sump 1*a* by virtue of the throttle 15, there is effected a lubrication of the bearing of the vacuum pump shaft (not shown) supported in the front wall 42. For this purpose oil is supplied in a branch conduit (port) 17. The port 17 is blocked outwardly by a plug 58.

The resilient closure 41 (shown in broken lines in FIG. 2) is secured to the front wall 42 by means of screws 46 and 47. The closure 41 covers the two openings 14 and 44 as well as the groove 43 surrounding the opening 14. The throttle 15 is formed by a bilateral piercing of the front wall 42. The throttle 45 is threadedly engaged in the front wall 42 by means of a thread 59 so that, dependent upon the suction power of the vacuum pump, different throttles 45 may be used.

It will be understood that the above description of the present invention is susceptible to various modifications, changes and adaptations and the same are intended to be comprehended within the meaning and range of equivalents of the appended claims.

What is claimed is:

1. A suction nipple arrangement forming a combination with a vacuum pump, said combination comprising:

(a) an oil circuit;

(b) an oil pump coupled to said oil circuit for driving oil therethrough;

(c) a pressure medium conduit having first and second ends; said pressure medium conduit being connected to said oil circuit at said second end;

(d) means forming an inlet opening at said second end;

(e) control means for maintaining closed said inlet opening during run of the vacuum pump and for maintaining open said inlet opening during standstill of the vacuum pump;

(f) a suction nipple valve including a cylinder being in communication with said pressure medium conduit at said first end thereof; a piston slidably received in said cylinder and being displaceable by a pressure medium entering said cylinder upon opening of said inlet opening by said control means; and a movable valve closing member operatively connected to said piston; and (g) means for maintaining a quantity of oil above said inlet opening in a closed state of said inlet opening whereby upon opening of said inlet opening by said control means initially solely oil is admitted through said inlet opening into said pressure medium conduit.

2. The combination as defined in claim 1, wherein said means for maintaining a quantity of oil above said inlet opening includes an oil reservoir communicating with said oil circuit and containing one part of said quantity of oil.

3. The combination as defined in claim 1, wherein said control means is arranged for opening or closing said inlet opening as a function of the oil pressure in said oil circuit.

4. The combination as defined in claim 1, wherein said vacuum pump includes a drive shaft and further wherein said oil pump is connected with said drive shaft to be driven thereby.

5. The combination as defined in claim 1, wherein said piston and said cylinder together define a gap, and further wherein the quantity of oil immediately above said inlet opening is limited to be just sufficient for sealing said gap during a valve closing motion of said piston in response to pressure medium admitted in said cylinder upon opening said inlet opening by said control means.

6. The combination as defined in claim 5, wherein said vacuum pump includes a pump chamber and said cylinder is in communication with said pump chamber, further wherein the gap width defined by a play between said piston and said cylinder is such that upon said movable valve closing member reaching a closed position, air advancing in said pressure medium conduit behind said quantity of oil is admitted to said pump chamber from said cylinder for an aeration of said pump chamber.

7. The combination as defined in claim 1, wherein said cylinder is a first cylinder and said piston is a first piston; further wherein said control means comprises a second cylinder, a second piston slidably received in said second cylinder and valve means operatively connected with said second piston and cooperating with said inlet opening.

8. The combination as defined in claim 7, wherein said second piston has opposite first and second end faces; further comprising a coupling conduit merging into said second cylinder adjacent said first end face of said second piston and maintaining communication between said oil circuit and said second cylinder; said pressure medium conduit merging, with said inlet opening, in said second cylinder adjacent said second end face thereof.

9. The combination as defined in claim 8, further comprising a spring engaging said second piston and exerting thereon a force opposing the force of pressure medium admitted to said second cylinder from said oil circuit through said coupling conduit to said first end face of said second piston.

10. The combination as defined in claim 8, wherein said valve means comprises a valve seat surrounding said inlet opening and a closing member mounted on said second piston and cooperating with said valve seat.

11. The combination as defined in claim 10, wherein said closing member comprises an extension threadedly engaged by said second piston.

12. The combination as defined in claim 8, further comprising an oil reservoir communicating with said second cylinder adjacent said second end face of said second piston; said oil reservoir having an open top for allowing overflow of oil; further wherein said second cylinder and said second piston together define a clearance for maintaining a continuous flow of oil through said clearance during run of the vacuum pump.

13. The combination as defined in claim 12, wherein said first piston and said first cylinder together define a gap, and further wherein the quantity of oil in said second cylinder above said inlet opening is so selected that during closing motion of said movable valve closing member by said first piston an oil seal between said first cylinder and said first piston is maintained and shortly after closing of said movable valve closing member, air advancing in said pressure medium conduit behind said quantity of oil is admitted from said first cylinder into a pump chamber for an aeration of said pump chamber.

14. A method of operating a vacuum pump having a suction nipple valve including a movable valve member, a piston connected to the movable valve member and a cylinder slidably receiving the piston, comprising the consecutive steps of (a) introducing oil under pressure into said cylinder, when the vacuum pump changes from a running state into a standstill state, for displacing the piston to move the movable valve member from an open position into a closed position and for sealing a clearance defined between said piston and said cylinder; and (b) introducing air under pressure into said cylinder after said movable valve member assumes the closed position, for passing the air between the cylinder and the piston into a vacuum pump chamber for an aeration thereof.

* * * * *